United States Patent [19]

Goyette

[11] Patent Number: 5,040,271

[45] Date of Patent: Aug. 20, 1991

[54] CUFF LINK ASSEMBLY

[76] Inventor: William A. Goyette, 463 Broad Street, Cumberland, R.I. 02864

[21] Appl. No.: 606,773

[22] Filed: Oct. 31, 1990

[51] Int. Cl.[5] ..... A44B 5/00

[52] U.S. Cl. ..... 24/102 R; 24/102 PL; 24/41

[58] Field of Search ..... 24/102 R, 102 SL, 102 FC, 24/102 PL, 41, 43, 44

[56] References Cited

U.S. PATENT DOCUMENTS

| | | | |
|---|---|---|---|
| 319,467 | 6/1885 | Doll | 24/102 PL |
| 2,177,443 | 10/1939 | Schupback | 24/102 |
| 2,236,788 | 4/1941 | Bullock | 24/102 PL |
| 2,270,677 | 1/1942 | Cronan | 24/102 PL |
| 2,598,281 | 5/1952 | Meeker | 24/102 PL |
| 3,080,630 | 3/1963 | Paliotta | 24/97 |
| 3,535,747 | 10/1970 | Benn | 24/41 |
| 4,566,155 | 1/1986 | Kurashima | 24/41 |

*Primary Examiner*—Victor N. Sakran

*Attorney, Agent, or Firm*—Salter & Michaelson

[57] ABSTRACT

A cuff link assembly includes an elongated stem member, an ornament member on one end of the stem member, a cross member and a fastening assembly pivotally securing the cross member on the opposite end of the stem member. The fastening assembly includes a pair of non circular cam structures on the stem member and a pair of cam plates having non circular cam sockets formed therein on the cross member, and the cam structures are received in the cam sockets for releaseably retaing the cross member in various different angular positive relative to the stem member.

8 Claims, 1 Drawing Sheet

CUFF LINK ASSEMBLY

BACKGROUND AND SUMMARY OF THE INVENTION

The instant invention relates to ornamental jewelry and more particularly to an effective and improved cuff link assembly.

Cuff links have been found to be relatively popular jewelry items for many years, and they have been found to significantly enhance the overall appearance of dress and formal wear shirts. However, the fastening assemblies of the heretofore available cuff links have generally been either ineffective for positively securing cuff links to the shirts of wearers, or they have been relatively complicated and expensive to manufacture. Hence, there is a need for a relatively simple yet effective fastening assembly for securing a cuff link to a cuff of a shirt of a wearer.

The closest prior art to the subject invention of which the applicant is aware is disclosed in the U.S. Pat. Nos. 2,177,443 to Schupbach; 3,080,630 to Paoliotta; 3,535,747 to Benn; and 4,566,155 to Kurashima. However, since these references fail to suggest a cuff link assembly comprising a pivotable fastening assembly of the type included in the cuff link assembly of the instant invention they are believed to be of only general interest as will hereinafter be made apparent.

The instant invention provides an effective cuff link assembly comprising an fastening assembly which is both adapted for relatively inexpensive constructions and operative for positively securing a cuff link to a cuff of a shirt of a wearer. More specifically, the cuff link assembly of the instant invention comprises an elongated stem member having opposite first and second ends and an ornament member on the first end of the stem member. The stem member has an elongated longitudinally extending slit formed therein which extends inwardly from the second end thereof to define a pair of closely spaced resiliently deflectable legs in the stem member. The cuff link assembly further comprises a pair of male cam halves on at least one side of the stem member adjacent to the second end thereof. The male cam halves are disposed on opposite legs of the stem member, and they are configured so that they cooperate to define a peripheral cam surface of noncircular configuration which extends outwardly from the stem member. The cuff link assembly further comprises an elongated cross member and means engaging the cam surface of the cam member for retaining the cross member on the second end of the stem member so that it is pivotable between a first position wherein the cross member is substantially parallel to the stem member and a second position wherein the cross member is substantially perpendicular thereto. The cuff link assembly preferably includes first and second pairs of male cam halves which are positioned on the first and second sides of the stem member, respectively, and which cooperate to define substantially axially aligned first and second cam structures on the stem member. The securing means preferably includes means engaging the cam surfaces of both of the cam structures for alternatively releasably retaining the cross member in the first position thereof or the second position thereof. The cam structures are preferably resiliently compressible by resiliently moving the first and second legs of the stem member together slightly to permit the cross member to be pivoted between the first position thereof and the second position thereof, and the securing means preferably includes closely spaced, substantially parallel first and second cam plates having first and second cam sockets formed therein, respectively, which are of substantially the same configuration as the peripheries of the first and second cam structures, respectively. The cam structures are received in the sockets in the female cam plates so that the cam halves of each cam structure are resiliently cammed together slightly as the cross member is pivoted between the first and second positions thereof. Still further, the cam structures are preferably formed in rounded octangular configurations so that the cam structures and the cam plates are operative for releasably securing the cross member in the first or second position thereof as well as in an intermediate position, which is approximately midway between the first and second positions.

Accordingly, it is a primary object of the instant invention to provide an effective cuff link assembly which is adapted for relatively inexpensive constructions.

Another object of the instant invention is to provide a cuff link assembly comprising a stem member having a pair of resiliently compressible cam members thereon which are operative for releasably securing a cross member in first or second positions thereof wherein the cross member is substantially parallel to the stem member or substantially perpendicular thereto, respectively.

An even still further object of the instant invention is to provide a cuff link assembly comprising an elongated stem member having a pair of resiliently compressible rounded octangular cam structures thereon which are operative for releasably securing a cross member in a first position wherein the cross member is substantially parallel to the stem member, a second position wherein the cross member is substantially perpendicular to the stem member, or a third position wherein the cross member is in an intermediate angular position relative to the stem member.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
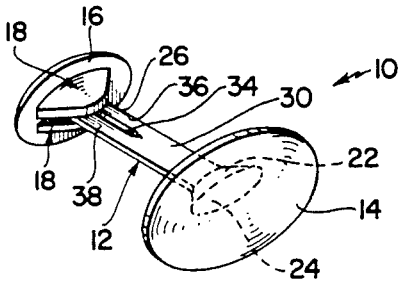
FIG. 1 is a perspective view of the cuff link assembly of the instant invention.
Figure 2:
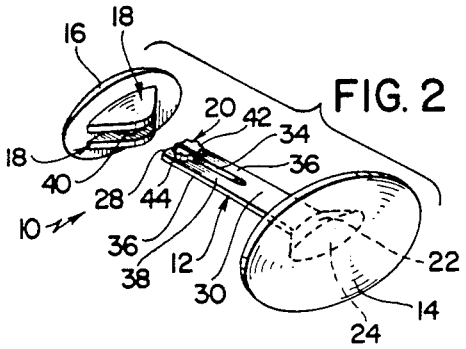
FIG. 2 is an exploded perspective view thereof.
Figure 3:
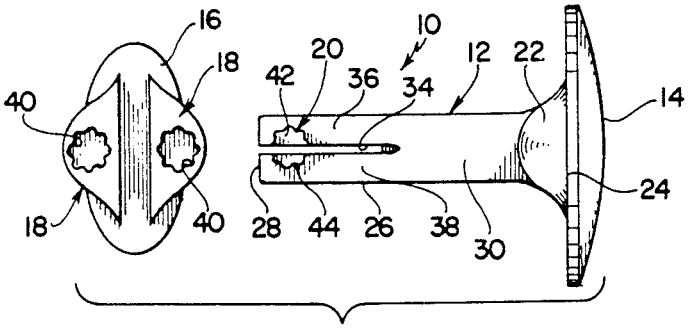
FIG. 3 is an enlarged exploded side elevational view thereof with the cross member pivoted 90° relative to the stem member.

Referring now to the drawing, the cuff link assembly of the instant invention is illustrated and generally indicated at 10 in FIGS. 1–5. The cuff link assembly 10 comprises an elongated stem member generally indicated at 12, an ornament member 14, a pair of cam plates generally indicated at 18, and a pair of cam structures generally indicated at 20. The ornament member 14 is secured to one end of the stem member 12, and the cross member 16 is secured to the opposite end of the stem member 12 with the cam plates 18 and the cam structures 20. More specifically, the cross member 16 is secured to the stem member 12 so that it is pivotable relative to the stem member 12 between a first position wherein the cross member 16 is substantially parallel to the stem member 12 and a second position wherein the cross member 16 is substantially perpendicular thereto.

The stem member 12 is preferably made from a suitable decorative metal, and it includes an enlarged outwardly flared first end portion 22 which terminates in a first end 24 and an opposite second end portion 26 which terminates in a second end 28. The stem member 12 is of generally elongated flattened configuration, and it has first and second sides 30 and 32, respectively. An elongated longitudinally extending slit 34 extends inwardly a distance from the second end 28 to define first and second resiliently deflectable legs 36 and 38, respectively, in the second end portion 26.

The ornament member 14 is of conventional construction, and it is adapted to provide a suitable decorative ornament for the cuff link assembly 10. The ornament portion 14 is secured to the first end 24 by suitable means, such as by soldering.

The cross member 16 is of generally oval shaped configuration, and it is preferably also made from a suitable metal. The cross member 16 has a longitudinal dimension which is substantially greater than the width of the stem member 12 so that when the cross member 16 is secured to the stem member 12 in the manner illustrated in FIGS. 1 and 5, the cross member 16 can be effectively utilized for retaining the cuff link assembly 10 on the cuff of a garment of a wearer. The cross member 16 is preferably dimensioned so that the width thereof is slightly less than the length of a conventional cuff link hole in a french shirt cuff and s that the longitudinal dimension of the cross member 16 is greater than the length of a conventional cuff link hole. Accordingly, by longitudinally advancing the cross member 16 through a cuff link hole in a shirt cuff and then pivoting the cross member 16 to the position illustrated in FIGS. 1–5, the cross member 16 can be effectively utilized for retaining the cuff link assembly 10 on the shirt cuff.

Figure 4:
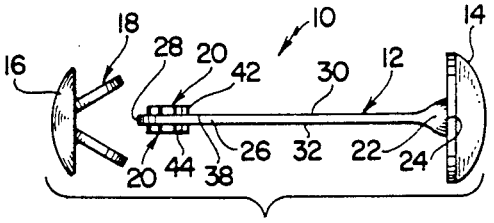
FIG. 4 is a another exploded side elevational view of the cuff assembly.
Figure 5:
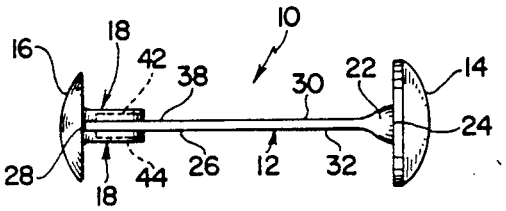
FIG. 5 is a fully assembled side elevational view thereof.

The female cam plates 18 are preferably integrally formed with the cross member 16, and they are initially formed so that they extend angularly outwardly in diverging relation from the cross member 16 in the manner illustrated in FIG. 4. However, the cam plates 18 are formed so that they are bendable inwardly and together to the positions illustrated in FIGS. 1, 2 and 5 wherein the cam plates 18 are in closely spaced substantially parallel relation. Each of the cam plates 18 has a female cam socket 44 formed therein which is of generally rounded octangular configuration as illustrated. The cam sockets 40 are oriented so that when the cam plates are in closely spaced substantially parallel relation, the cam sockets 40 are in substantially coaxial relation.

The male cam structures 20 are also of generally rounded octangular configuration, and each of the cam structures 20 includes first and second male cam halves 42 and 44, respectively, which are formed on the first and second legs 36 and 38, respectively, so that the cam halves 40 and 42 of each cam structure 20 cooperate to define a structure which is of substantially the same configuration and dimension as one of the sockets 40. The male cam structures 20 are formed on opposite sides of the stem member 12, and they are formed in substantially coaxial relation. The male cam structures 20 are received in the sockets 40 in the manner illustrated in FIG. 5 so that the female cam plates 18 cooperate to retain the cross member 16 on the stem member 12. However, because the two cam halves 42 and 44 of each cam structure 20 are formed on different legs 36 and 38, the cam halves 42 and 44 of each cam structure 20 are resiliently deflectable together slightly by deflecting the legs 36 and 38 together as the cross member 16 is pivoted relative to the stem member 12.

For use and operation of the cuff link assembly 10, the cross member 16 is pivoted to a position wherein it is substantially parallel to the stem member 12. In this regard, the configurations of the sockets 40 and the male cam structures 20 are such that the cross member 16 is releasably securable in a position wherein it is substantially parallel to the stem member 12. The cross member 16 and the second end portion 26 of the stem member 12 can then be passed through a cuff link hole in a french cuff of a shirt in order to assemble the cuff link assembly 10 thereon. Once the cuff link assembly 10 has been positioned in a desired location on the shirt cuff, the cross member 16 can then be pivoted to a position wherein it is substantially perpendicular to the stem member 12. In this connection, because the legs 36 and 38 are resiliently deflectable, the peripheries of first and second cam halves 42 and 44 can be resiliently compressed slightly to allow the bumps in the interiors of the sockets 40 to pass over the bumps on the cam halves 42 and 44 in order to reposition the cross member 16 in substantially perpendicular relation to the stem member 12. Once the cross member 16 has been repositioned in this manner, it can be effectively utilized for retaining the cuff link assembly 10 on a shirt cuff, and the cam structures 20 cooperate with the sockets 40 to releaseably retain the cross member 16 in substantially perpendicular relation to the stem member 12. Further, in the event that it is desired to position the cross member 16 in an angular relation of approximately 45° relative to the stem member 12 in order to better position the ornament member 14 relative to a shirt cuff, the cross member 16 can be pivoted to an intermediate position which is approximately midway between the first position thereof wherein the cross member 16 is substantially parallel to the stem member 12 and the second position thereof wherein it is substantially perpendicular thereto. In this connection, the octangular configurations of the sockets 40 and the male cam structures 20 enable the cross members 16 to be secured in either of the first or second positions thereof as well as in intermediate positions wherein the cross member 16 is in an intermediate angular relation to the stem member 12.

It is seen therefore that the instant invention provides an effective cuff link assembly. The cam structures 20 and the female cam plates 18 effectively cooperate to secure the cross member 16 on the stem member 12 in a manner which enables the cross member 16 to be effectively releasably retained in various positions relative to the stem member 12. Accordingly, the cross member 16 can be effectively and easily assembled on a shirt cuff, and it can be utilized for effectively retaining the cuff link assembly 10 on a shirt cuff. Further, the cross member 16 can be positioned in an angular orientation to reorient the ornament member 14 relative to a shirt cuff if desired. Accordingly, it is seen that the cuff link assembly of the instant invention represents a significant advancement in the jewelry art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A cuff link assembly comprising a. an elongated stem member having longitudinally opposite first and second end portions terminating in first and second ends, respectively, said stem member also having opposite first and second sides, said second end portion having an elongated longitudinally extending slit formed therein which extends inwardly from said second end to define a pair of closely spaced resiliently deflectable legs;

b. an ornament member on the first end of said stem member;

c. a pair of male cam halves on at least one of said first and second sides of said stem member, said male cam halves being disposed on opposite legs and cooperating to define a cam structure having a cam surface of non-circular configuration thereon;

d. an elongated cross member; and e. securing means pivotally securing said cross member to said stem member adjacent the second end therof, said securing means including means engaging said cam surface for alternatively releasably retaining said cross member in a first position wherein said cross member is substantially parallel to said stem member or a second position wherein said cross member is substantially perpendicular to said stem member.

2. In the cuff link assembly of claim 1, said cam halves having outer peripheral surfaces which extend outwardly from said at least one side of said stem member, the outer peripheral surfaces of said cam halves cooperating to define said cam surface.

3. The cuff link assembly of claim 1 further comprising first and second pairs of said male cam halves, one pair of said male cam halves being disposed on each side of said stem member, each pair of male cam halves cooperating to define a cam structure, said securing means including means engaging the cam surface of each of said cam structures for alternatively releasably retaining said cross member in said first position or said second position.

4. In the cuff link assembly of claim 1, said cam structure being resiliently compressible slightly by resiliently deflecting said first and second legs together slightly to permit said cross member to be pivoted from said first position thereof to said second position thereof.

5. In the cuff link assembly of claim 2, said securing means including a female cam plate having a female cam socket formed therein, said female cam socket being of substantially the same configuration as the periphery of said cam structure as defined by said cam surface, said cam structure being received in said cam socket, said cam halves being resiliently cammed together slightly as said cross member is pivoted between said first and second positions thereof.

6. In the cuff link assembly of claim 5, said cam structure being of substantially rounded octangular configuration.

7. In the cuff link assembly of claim 1, said securing means securing said cross member so that it is alternatively pivotable to and releasably securable in a third position which is approximately midway between said first and second positions.

8. In the cuff link assembly of claim 3, said securing means including a pair of spaced substantially parallel female cam plates, each of said cam plates having a female cam socket therein, each of said female cam sockets being of substantially the same configuration as the periphery of one of said cam structures as defined by the respective cam surface thereof, each of said cam structures being received in one of said cam sockets, the cam halves of each cam structure being cammed together slightly as said cross member is pivoted between said first and second positions thereof.

* * * * *